US007931526B2

(12) United States Patent
Ramirez

(10) Patent No.: US 7,931,526 B2
(45) **Date of Patent: *Apr. 26, 2011**

(54) 21 TO THE RIVER

(75) Inventor: Anthony Ramirez, Las Vegas, NV (US)

(73) Assignee: Hands Down, LLC, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/683,107

(22) Filed: Jan. 6, 2010

(65) Prior Publication Data

US 2010/0109246 A1 May 6, 2010

Related U.S. Application Data

(63) Continuation of application No. 12/050,030, filed on Mar. 17, 2008, now Pat. No. 7,665,737.

(51) Int. Cl.
*A63F 1/00* (2006.01)

(52) U.S. Cl. ..... 463/12; 273/292

(58) Field of Classification Search ..... 273/292, 273/274, 309; 463/12, 13

See application file for complete search history.

(56) References Cited

U.S. PATENT DOCUMENTS

| | | | | |
|---|---|---|---|---|
| 5,988,643 | A | 11/1999 | Awada | |
| 6,012,719 | A * | 1/2000 | Webb | 273/292 |
| 6,402,148 | B1 | 6/2002 | Saruwatari | |
| 6,406,023 | B1 | 6/2002 | Rowe | |
| 6,409,174 | B1 | 6/2002 | Demarest | |
| 6,481,717 | B1 | 11/2002 | Richardelle | |
| 6,776,416 | B1 | 8/2004 | Jackson | |
| 6,869,075 | B1 | 3/2005 | Stavinsky | |
| 6,874,786 | B2 | 4/2005 | Bruno et al. | |
| 2001/0040344 | A1 | 11/2001 | Zahedi | |
| 2002/0113371 | A1 | 8/2002 | Snow | |
| 2004/0048662 | A1 | 3/2004 | Ulmer | |

* cited by examiner

*Primary Examiner* — Benjamin H Layno
(74) *Attorney, Agent, or Firm* — Dickinson Wright PLLC

(57) ABSTRACT

A method of playing a Blackjack game provides a side-bet against a bust. Should a bust occur the bust card is combined with four subsequently dealt playing cards to define a five-card poker hand. This resulting poker hand is compared to a predetermined hierarchy of poker hands, and payouts are awarded for winning outcomes.

20 Claims, 2 Drawing Sheets

POKER PAY OUTS

| HAND | PAYS |
|---|---|
| JACK'S OR BETTER | 1 TO 1 |
| TWO PAIR | 1 TO 1 |
| THREE OF A KIND | 3 TO 1 |
| STRAIGHT | 5 TO 1 |
| FLUSH | 8 TO 1 |
| FULL HOUSE | 20 TO 1 |
| FOUR OF A KIND | 40 TO 1 |
| FIVE OF A KIND | 100 TO 1 |
| STRAIGHT FLUSH | 250 TO 1 |
| ROYAL FLUSH | 500 TO 1 |

44

14

21 TO THE RIVER

CROSS-REFERENCE TO RELATED APPLICATION

This application is a continuation of U.S. patent application Ser. No. 12/050,030, filed Mar. 17, 2008 which claims the benefit of U.S. Provisional Patent Application Ser. No. 60/895,050, filed Mar. 15, 2007.

BACKGROUND OF THE INVENTION

1. Field of the Invention

This invention is in the field of gaming and, more particularly, wagering games using playing cards or images of playing cards. More specifically, the present invention relates to a casino-style game played under the rules of Blackjack with optional subsequent play utilizing a payout table of poker.

2. Related Art

Two major factors affect the profitability of casino playing card table games: (1) the house advantage; and (2) the quantity of games that can be played in a given period of time. It is difficult to make significant changes to either without encountering resistance from players—as well as dealers.

While all types of new table games are being presented to casinos for test marketing, there is a reluctance to depart greatly from the existing games offered. Casinos are understandably reluctant to replace known table games with new games/playing surfaces where their present tables regularly provide predictable streams of revenue for the casino. Additionally, new games present learning challenges to both players and dealers, tending to slow down table action, and table receipts.

Blackjack and poker are probably the most widely known playing card games, and thus are among the most commonly offered by casinos. As casinos look for ways to increase table profitability, side betting features are appearing in proposed variations to both blackjack and poker. Unfortunately, most seem to add complexities that result in either few players participating or an overall slowdown in game cycles that offset all or part of the gains made through the side betting.

There is a need for new casino-style playing card games that include new betting opportunities for players within well-known and widely understood—or easily learned, playing card games. There is a further need for playing card games that offer players a second opportunity for winning—particularly in the form of a consolation bet if an initial wager is lost.

BACKGROUND OF THE INVENTION

The casino card game of 21 TO THE RIVER™ is an exhilarating playing card game that combines blackjack and poker into a single formatted game.

It is an advantage of the present invention to meet the foregoing needs, and others, by providing a playing card game that is house-banked with an added wagering feature played as a side bet with blackjack. A player must make a blackjack wager and a poker wager (termed "21 TO THE RIVER™" wager) in order to play. Wagering limits are set by the house.

It is a further advantage of the present invention that upon both wagers being placed, play proceeds under the rules of blackjack. When a player bust occurs, the bust card is utilized as an initial card in a 5-card poker hand, the dealer provides four additional cards, and the resulting five card hand is compared to a poker payout table to determine winning results.

A method of playing a wagering game, comprising: placing a first wager to participate in a casino blackjack-type game; placing a second wager to participate in a side bet; resolving said first wager through completion of said casino blackjack-type game under conventional rules of blackjack; and resolving said second wager for such players as obtain a bust playing card as a result of said resolved first wager, said resolution of said second wager in accordance with a winning event table and utilizing a value of said bust playing card and only such additional cards as are provided by a dealer after resolution of said first wager.

A method of playing a live casino blackjack game comprising: placing a side-bet wager; dealing and resolving a conventional blackjack playing card game; identifying a busted hand; separating a bust card from all other playing cards in said busted hand; combining said bust card with a plurality of subsequently dealt playing cards to define a poker hand; evaluating said poker hand according to a winning event table; and making a payout on said side-bet wager for one of a plurality of winning outcomes.

These and various other advantages and features of the present invention are pointed out with particularity in the claims. Reference should also be had to the drawings which form a further part hereof, as well as to the accompanying descriptive matter in which are illustrated and described in various examples of with the invention.

DETAILED DESCRIPTION OF THE PREFERRED EMBODIMENTS

Figure 1:
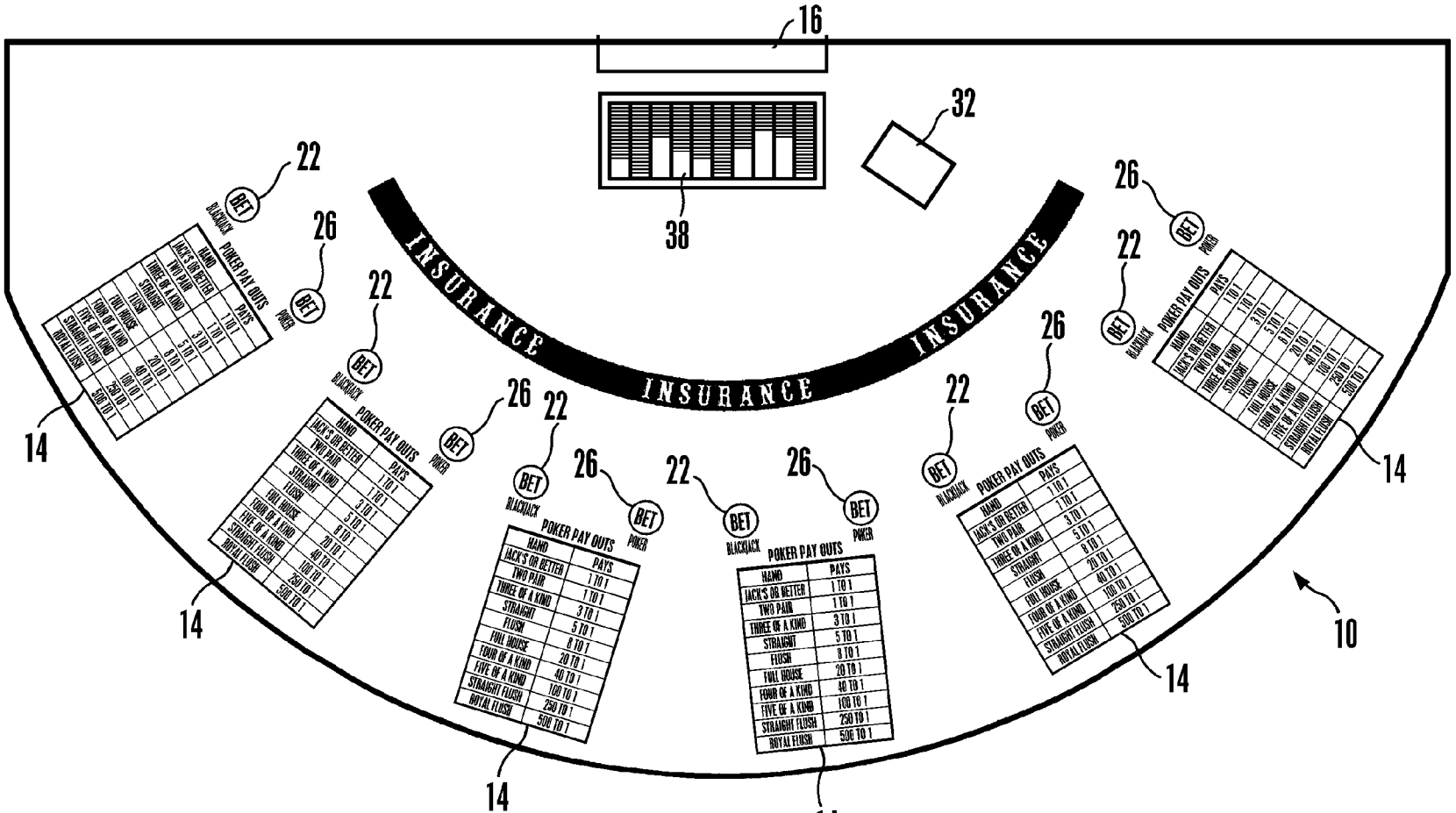
FIG. 1 is a plan view showing a group of indicia on a playing surface defining a plurality of individual playing areas whereupon a game is played in accordance with the preferred embodiment.

Reference is now made to the drawings wherein like numerals refer to like indicia throughout. In FIG. 1, a playing surface 10 is provided with a plurality of inscribed geometric shapes to assist in the play of a card game described hereinafter.

Figure 2:
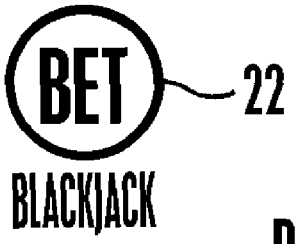
FIG. 2 is an enlarged plan view showing one of said plurality of individual playing areas.
Figure 2:
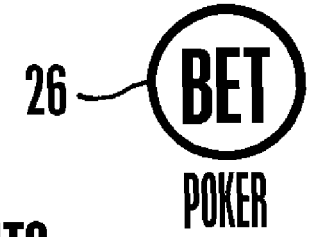

A plurality of player positions 14 and a dealer position 16 are spaced opposite one-another on the playing surface 10. Each of the player positions is provided with a pair of wagering areas; a first, blackjack betting area 22 and a second, poker betting area 26 (also see FIG. 2 for an enlarged view of the player position 14). As will be discussed in greater detail hereinafter, a player must place a wager in each of these two wagering areas in order to participate in the play of the preferred embodiment of the present invention.

A preferred embodiment of the present invention contemplates the use of multiple 52-card decks of playing cards placed in a playing card shoe 32. Each deck comprises a standard deck minus any jokers, with the cards located in the playing card shoe 32 used to deal each of the player's hands as well as the dealer's hand. A chip rack 38 is located adjacent the dealer position 16 and holds playing chips of typical wagering denominations.

As mentioned in the foregoing, it is presently contemplated that the game will be played with multiple 52-card decks of playing cards—preferably six decks, although it is to be understood and appreciated that play with a single deck also lies within the present invention.

A presently preferred embodiment of the present game is played using standard blackjack rules, with six decks of cards and up to 6 players. Play begins by each player making a blackjack wager and a poker wager. These wagers can be of any size so long as they are within the house limits, and in the presently preferred embodiment, the two wagers are not required to be of the same size. Additionally, in the presently preferred embodiment such a poker wager (also termed a 21 TO THE RIVER™ wager) is mandatory for all players; however, playing where such wagers are optional is considered to lie within the present invention.

As in conventional blackjack, each player receives 2 cards, one at-a-time, face up, and in a clockwise rotation with the other players. The dealer also receives 2 cards; the first card facing down and the second card facing up. As in conventional blackjack, each of the players plays his/her blackjack hand in a normal fashion, including hitting, standing, doubling, and splitting in accordance with house rules. The player either achieves a total of 21 or less, or else the player busts with a playing card total of 22 or greater.

If the player's final total is 21 or less, then the blackjack wager is resolved as usual, and the poker wager ("21 TO THE RIVER™" wager) is considered a push. If the player's final total is 22 or greater, the player is said to "bust" and, as with conventional Blackjack rules, that player forfeits his/her blackjack wager. The final card the player received that caused the "bust" (termed the "bust card") is then used as that player's first card for the poker wager.

For those situations where the player splits his/her blackjack hand, the first hand that busts is the one used for the poker wager. If no hand busts after splitting, then the poker wager is considered a "push."

The losing blackjack wager is removed by the dealer and the bust card is set in front of the poker wager, face up. The remaining cards for the blackjack hand are removed by the dealer.

After all blackjack hands are resolved by the dealer, the dealer goes to the first player with a bust card and deals that player four additional cards to make a five-card poker hand. That five-card hand is then evaluated against a winning event table 44 and paid according to the listed odds and the wager initially placed. All cards are then collected from the player, and if no winning result, the poker wager is removed, and play continues in rotation with the next player having a bust card, until all poker wagers are resolved.

The rules and play of the game are described below in a series of examples.

EXAMPLE 1

This game is played with six decks of cards and up to six players. After the initial blackjack and poker wagers are made, the dealer shuffles the cards and gives each player two cards, face up, and one at a time.

The first player is dealt a "10" and a "4" (as in traditional blackjack, the card suit is irrelevant) for a point total of fourteen (14). The dealer gives the first player an option to "hit" or "stay", the first player elects to "hit," and receives a Queen. Face cards have a ten-point value, so the first player's hand now has a point total of twenty four (24). This point total exceeds twenty one (21) so the first player's hand "busts," resulting in a loss of the first player's blackjack bet. The blackjack hands for the other players are then resolved, before the dealer returns to the busted first player.

Since the first player busted on the third card, the dealer had previously placed the bust card—the "Queen", in front of the poker wagering area 26. The dealer deals the first player an additional four cards, face up: "3", "Ace", "Queen", and "7". Winning hands require a pair of "Jacks" or higher to win, and here, the first player wins by having a pair of "Queen's". Dealer pays the first player even money for this winning pair.

EXAMPLE 2

After making the initial blackjack and poker wagers, the second player is initially dealt an "Ace" and a "9" for a total of twenty (20) points. The second player elects to "stay." The dealer's cards are a "7" and a "10," for a point total of seventeen (17). The house rules require the dealer to "stay" with that point total, so the second player wins at blackjack. The (unused) poker bet results in a push.

EXAMPLE 3

After the initial blackjack and poker wagers are made, the third player receives a "7" and a "7" from the initial blackjack deal. The third player elects to split his/her cards, and puts down a second bet. The third player "hits" on his first "7"; and receives a '10" for a total of seventeen (17). The third player decides to "stay" on that hand.

Dealer advises the third player that it is a "push," then places a second card, "6", on the second "7" for a hand total of thirteen (13). The third player elects to receive another "hit," and receives a "9" for a point total of twenty two (22)—for a player bust. Since the third card was the bust card, the player plays the poker hand beginning with the "9" bust card. The third player will need a pair of Jacks or higher to win even money on the poker hand.

The blackjack payouts are preferably standard payouts typical for the game of blackjack. It is to be understood that the payouts can be established by the house, and thus can vary from the presently preferred payouts for the poker option as are set forth below:

| Payout Hand | Payout |
|---|---|
| Royal Flush | 500 to 1 |
| Straight Flush | 250 to 1 |
| Five of a Kind | 100 to 1 |
| Four of a Kind | 40 to 1 |
| Full House | 20 to 1 |
| Flush | 8 to 1 |
| Straight | 5 to 1 |
| Three of a Kind | 3 to 1 |
| Two Pairs | 1 to 1 |
| Pair of Jacks or Higher | 1 to 1 |

A payout is limited to only the highest hand value (should one hand satisfy two or more winning payouts), and there is no payout associated with any other hand.

The present invention can easily be adapted for play on an electronic gaming machine and it is to be understood and appreciated that such an adaptation and manner of use lies within the scope of the present invention.

The present invention has been disclosed in terms of a preferred embodiment thereof, which provides a casino wagering game that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A method of playing a wagering game, comprising:

providing an electronic gaming machine configured to display images of playing cards;

providing a non-transitory computer readable medium coded with instructions and executed by a processor to perform the steps of:

placing a first wager through the electronic gaming machine to participate in a casino blackjack-type game;

placing a second wager through the electronic gaming machine to participate in a side bet;

resolving said first wager through completion of said casino blackjack-type game under conventional rules of blackjack including the player receiving images of cards to form an initial blackjack hand, allowing the player to receive additional images of cards, a player busting if an additional card image received by the player results in the player's final blackjack hand exceeding 21, and the busting player forfeiting said first wager;

resolving said second wager only if the player received an additional card image resulting in the player's hand busting during the playing of the conventional blackjack game, and identifying the additional card image as a bust playing card;

separating the bust playing card image from all other playing card images used in the busted player's hand in the conventional blackjack game, and discarding all the other playing card images from play;

combining only said bust playing card image with a plurality of subsequently dealt playing card images to define a poker hand;

evaluating said poker hand according to a winning event table; and making a payout on said second wager for one of a plurality of winning outcomes.

2. The method of claim 1, wherein said winning event table comprises a predetermined hierarchy of poker hands.

3. The method of claim 2, wherein said resolution of said second wager for the player that does not obtain a bust card image is a predetermined outcome.

4. The method of claim 3, wherein said predetermined outcome is a push.

5. The method of claim 1, wherein said resolution of said second wager for the player that does obtain a bust playing card image comprises the steps of:

identifying said bust playing card image, selecting said bust playing card image and discarding all such other playing card images as were obtained during resolution of said first wager, dealing an additional number of playing card images such that said bust playing card image and said additional number of playing card images define a virtual poker hand, and evaluating said poker hand according to a winning event table.

6. The method of claim 5, wherein said additional number of playing card images is four, and wherein said poker hand consists of five playing card images.

7. The method of claim 5, and further comprising:

making a payout to the player on said second wager for one of a plurality of winning outcomes.

8. The method of claim 7, wherein said winning event table comprises a predetermined hierarchy of poker hands.

9. The method of claim 8, wherein the predetermined winning outcomes is at least a pair of Jacks.

10. The method of claim 8, wherein the second wager is optional.

11. The method of claim 8, wherein the second wager is mandatory.

12. A method of playing a wagering game in and through an electronic gaming machine configured to display images of playing cards, comprising:

providing a non-transitory computer readable medium coded with instructions and executed by a processor to perform the steps of:

placing a first wager through the electronic gaming machine to participate in a casino blackjack-type game;

placing a second wager through the electronic gaming machine to participate in a side bet;

resolving said first wager through completion of said casino blackjack-type game under conventional rules of blackjack, said resolving step including producing images of cards with the electronic gaming machine to form an initial blackjack hand, allowing the player to receive additional images of cards in the display of the electronic gaming machine, a player busting if an additional card image produced with the electronic gaming machine results in the player's final blackjack hand exceeding 21, and the busting player forfeiting said first wager;

resolving said second wager within the electronic gaming machine only if the player received an additional card image resulting in the player's hand busting during the playing of the conventional blackjack game, and identifying the additional card image as a bust playing card;

separating the bust playing card image from all other playing card images used in the busted player's hand in the display of the electronic gaming machine, and discarding all the other playing card images from play;

combining in the display of the electronic gaming machine only said bust playing card image with a plurality of subsequently dealt playing card images to define a poker hand;

evaluating within the electronic gaming machine said poker hand according to a winning event table; and making a payout with the electronic gaming machine on said second wager for one of a plurality of winning outcomes.

13. The method of claim 12, wherein said winning event table comprises a predetermined hierarchy of poker hands.

14. The method of claim 13, wherein said resolution of said second wager for the player that does not obtain a bust card image is a predetermined outcome.

15. The method of claim 14, wherein said predetermined outcome is a push.

16. The method of claim 12, wherein said resolution of said second wager for the player that does obtain a bust playing card image comprises the steps of:

identifying said bust playing card image, selecting said bust playing card image and discarding all such other playing card images as were obtained during resolution of said first wager, dealing an additional number of playing card images such that said bust playing card image and said additional number of playing card images define a virtual poker hand, and evaluating said poker hand according to a winning event table.

17. The method of claim 16, wherein said additional number of playing card images is four, and wherein said poker hand consists of five playing card images.

18. The method of claim 16, and further comprising:

making a payout to the player on said second wager for one of a plurality of winning outcomes.

19. The method of claim 18, wherein said winning event table comprises a predetermined hierarchy of poker hands.

20. The method of claim 19, wherein the second wager is mandatory.

* * * * *